US007115348B2

(12) United States Patent
Zhu et al.

(10) Patent No.: US 7,115,348 B2
(45) Date of Patent: Oct. 3, 2006

(54) PHOTORECEPTOR FOR ELECTROPHOTOGRAPHY HAVING AN OVERCOAT LAYER WITH SALT

(75) Inventors: Jiayi Zhu, Woodbury, MN (US); Kam Wah Law, Woodbury, MN (US)

(73) Assignee: Samsung Electronics Co., Ltd., Suwon (KR)

( * ) Notice: Subject to any disclaimer, the term of this patent is extended or adjusted under 35 U.S.C. 154(b) by 20 days.

(21) Appl. No.: 10/657,607

(22) Filed: Sep. 8, 2003

(65) Prior Publication Data

US 2004/0101772 A1 May 27, 2004

Related U.S. Application Data

(60) Provisional application No. 60/429,822, filed on Nov. 27, 2002.

(51) Int. Cl.
*G03G 5/147* (2006.01)

(52) U.S. Cl. ..... 430/66; 399/238

(58) Field of Classification Search ..... 430/66, 430/67, 117; 399/238
See application file for complete search history.

(56) References Cited

U.S. PATENT DOCUMENTS

| | | | | |
|---|---|---|---|---|
| 4,015,984 | A | 4/1977 | Ohta et al. | |
| 4,152,152 | A | 5/1979 | Contois et al. | |
| 4,264,696 | A | 4/1981 | Kawashima et al. | |
| 4,933,246 | A | 6/1990 | Teuscher | |
| 5,045,421 | A * | 9/1991 | Fuse et al. | 430/58.4 |
| 5,204,201 | A | 4/1993 | Schank et al. | |
| 5,288,573 | A | 2/1994 | Hung et al. | |
| 5,342,718 | A | 8/1994 | Nousho et al. | |
| 5,693,442 | A * | 12/1997 | Weiss et al. | 430/66 |
| 5,731,117 | A | 3/1998 | Ferrar et al. | |
| 6,066,425 | A * | 5/2000 | Ferrar et al. | 430/58.1 |
| 6,139,999 | A * | 10/2000 | Fuller et al. | 430/58.65 |
| 6,187,491 | B1 | 2/2001 | Ferrar et al. | |
| 6,365,309 | B1 | 4/2002 | Tokutake et al. | |
| 6,383,699 | B1 | 5/2002 | Yuh et al. | |
| 2003/0087172 | A1 | 5/2003 | Zhu et al. | |

FOREIGN PATENT DOCUMENTS

| | | |
|---|---|---|
| EP | 0433055 | 12/1990 |
| EP | 0632337 | 1/1995 |
| GB | 2052081 | 1/1981 |
| JP | 01276142 | 6/1989 |
| JP | 10-239874 | 9/1998 |
| JP | 11-133648 | 5/1999 |
| JP | 2000-267321 | 9/2000 |
| JP | 2002-006528 | 1/2002 |

* cited by examiner

*Primary Examiner*—John L Goodrow
(74) *Attorney, Agent, or Firm*—Patterson, Thuente, Skaar & Christensen, P.A.

(57) ABSTRACT

Improved organophotoreceptors comprise an electrically conductive substrate; a photoconductive element comprising a charge generation compound; and an overcoat layer comprising a first binder and at least a salt, wherein the photoconductive layer is on the electrically conductive substrate, wherein the overcoat layer is on the photoconductive layer and wherein the binder is not a silsesquioxane polymer.

33 Claims, No Drawings

PHOTORECEPTOR FOR ELECTROPHOTOGRAPHY HAVING AN OVERCOAT LAYER WITH SALT

CROSS REFERENCE TO RELATED APPLICATIONS

This application claims priority to copending Provisional U.S. Patent Application Ser. No. 60/429,822 to Zhu et al. filed on Nov. 27, 2002, entitled "Novel Release Layer With Salt Containing Small Cation," incorporated herein by reference.

FIELD OF THE INVENTION

This invention relates to organophotoreceptors suitable for use in electrophotography and, more specifically, to organophotoreceptors having an overcoat layer comprising a salt, such as an inorganic salt.

BACKGROUND OF THE INVENTION

In electrophotography, an organophotoreceptor in the form of a plate, disk, sheet, belt, drum or the like having an electrically insulating photoconductive element on an electrically conductive substrate is imaged by first uniformly electrostatically charging the surface of the photoconductive layer, and then exposing the charged surface to a pattern of light. The light exposure selectively dissipates the charge in the illuminated areas where light strikes the surface, thereby forming a pattern of charged and uncharged areas, referred to as a latent image. A liquid or solid toner is then provided in the vicinity of the latent image, and toner droplets or particles deposit in the vicinity of either the charged or uncharged areas to create a toned image on the surface of the photoconductive layer. The resulting toned image can be transferred to a suitable ultimate or intermediate receiving surface, such as paper, or the photoconductive layer can operate as an ultimate receptor for the image. The imaging process can be repeated many times to complete a single image, for example, by overlaying images of distinct color components or effect shadow images, such as overlaying images of distinct colors to form a full color final image, and/or to reproduce additional images.

Both single layer and multilayer photoconductive elements have been used. In single layer embodiments, a charge transport material and charge generating material are combined with a polymeric binder and then deposited on the electrically conductive substrate. In multilayer embodiments, the charge transport material and charge generating material are present in the element in separate layers, each of which can optionally be combined with a polymeric binder, deposited on the electrically conductive substrate. Two arrangements are possible. In one two-layer arrangement (the "dual layer" arrangement), the charge generating layer is deposited on the electrically conductive substrate and the charge transport layer is deposited on top of the charge generating layer. In an alternate two-layer arrangement (the "inverted dual layer" arrangement), the order of the charge transport layer and charge generating layer is reversed.

In both the single and multilayer photoconductive elements, the purpose of the charge generating material is to generate charge carriers (i.e., holes and/or electrons) upon exposure to light. The purpose of the charge transport material is to accept at least one type of these charge carriers, generally holes, and transport them through the charge transport layer in order to facilitate discharge of a surface charge on the photoconductive element. The charge transport material can be a charge transport compound, an electron transport compound, or a combination of both. When a charge transport compound is used, the charge transport compound accepts the hole carriers and transports them through the layer with the charge transport compound. When an electron transport compound is used, the electron transport compound accepts the electron carriers and transports them through the layer with the electron transport compound.

SUMMARY OF THE INVENTION

This invention provides a polymeric overcoat layer having a sufficient conductivity for improving the photoelectrical properties of organophotoreceptors such as "$V_{dis}$".

In a first aspect, the invention features an organophotoreceptor that includes:

a) an electrically conductive substrate;

b) a photoconductive element comprising a charge generation compound wherein the photoconductive element is on the electrically conductive substrate; and c) an overcoat layer comprising a first binder and an inorganic salt wherein the overcoat layer is on the photoconductive layer and wherein the polymeric binder is not a silsesquioxane polymer. In some embodiments, the inorganic salt has a cation selected from the group consisting of lithium cation and sodium cation.

In a second aspect, the invention features an electrophotographic imaging component that comprises (a) a light imaging apparatus; and (b) the above-described organophotoreceptor oriented to receive light from the light imaging component. The apparatus can further comprise a toner dispenser.

In a third aspect, the invention features an electrophotographic imaging process that includes (a) applying an electrical charge to a surface of the above-described organophotoreceptor; (b) imagewise exposing the surface of the organophotoreceptor to radiation to dissipate charge in selected areas and thereby form a pattern of charged and uncharged areas on the surface; (c) contacting the surface with a toner to create a toned image; and (d) transferring the toned image to a substrate.

DETAILED DESCRIPTION OF PREFERRED EMBODIMENTS

Improved organophotoreceptors comprise an overcoat layer on top of an electrically photoconductive layer (single layer or inverted dual layer) comprising at least a charge generating compound, in which the overcoat layer comprises a salt. Generally, the overcoat layer is on the photoconductive layer. In some embodiments, the overcoat layer can be applied as a release layer at the surface of the organophotoreceptor. The overcoat layer can improve the performance of the organophotoreceptor in electrophotographic applications. In some embodiments, the overcoat layer with at least one salt compound provides the desirable properties of high "$V_{acc}$", low "$V_{dis}$", good mechanical abrasion for cycling, and good chemical resistance to ozone, carrier fluid and contaminants. In some embodiments, particularly desired performance is surprisingly obtained with salts having a small cation, such as a lithium ion or a sodium ion, and/or having a large anion.

Organophotoreceptors generally can comprise an overcoat layer that protects the underlying layers from mechanical degradations and attacks by chemicals such as carrier fluid, corona gases, and ozone. Generally, in order for an overcoat layer to provide the desired protection they should possess certain mechanical properties, and generally are applied in a substantially uniform thickness. Additionally, the overcoat material should be selected so as to not adversely affect the photoelectric properties of the organophotoreceptor.

The amount of charge that the charge transport composition can accept is indicated by a parameter known as the acceptance voltage or "$V_{acc}$", and the retention of that charge upon discharge is indicated by a parameter known as the discharge voltage or "$V_{dis}$". To produce high quality images, it is desirable to increase $V_{acc}$, and to decrease $V_{dis}$. The overcoat layer generally does not have an uppermost surface having a high conductivity so that a high "$V_{acc}$" can be obtained and latent image spread (LIS) along the surface is appropriately low. However, the overcoat layers generally does not possess a high electrical resistivity to electrons from the layers below the overcoat layer, such as a charge generating layer (single layer or inverted dual layer) or to holes from a charge transport layer (dual layer), so that the overcoat layer does not have a high "$V_{dis}$" or trap charges opposite to the polarity of the photoconductor.

There are overcoat layers for organophotoreceptors described in the art for protecting the underlying layers. Most of them comprise polymeric binders having very low conductivity. As a result, "$V_{dis}$" of the organophotoreceptors with a polymeric overcoat layer can be adversely affected. In order to improve "$V_{dis}$" of organophotoreceptors with a polymeric overcoat layer, new methods for increasing conductivity of the polymeric overcoat layers are desirable. There continues to be a need in particular embodiments for additional organophotoreceptors with an overcoat layer that provides a high "$V_{acc}$", a low "$V_{dis}$", a good mechanical abrasion for cycling, and a good chemical resistance to ozone, carrier fluid and contaminants.

The addition of salts to an overcoat layer, such as a release layer, can be effective to lower the $V_{dis}$ of the organophotoreceptor. Salts refer broadly to compounds that have a dominant degree of ionic bonding at least between two species within the compound, i.e., a cation and an anion. The anion and cation themselves can have covalent bonding within the ions. Also, a salt can comprise more than two ions, such as $MgCl_2$ with three ions. While decreased values of $V_{dis}$ is generally observed with any salt within an overcoat layer relative to the same overcoat material without a salt, it has been surprisingly discovered that lower values of $V_{dis}$ can be obtained with salt having smaller cations and/or having larger anions. Desirable features of the ions are described further below.

The organophotoreceptors described herein are particularly useful in laser printers and the like as well as photocopiers, scanners and other electronic devices based on electrophotography. The use of these organophotoreceptors is described in more detail below in the context of laser printer use, although their application in other devices operating by electrophotography can be generalized from the discussion below. To produce high quality images, particularly after multiple cycles, it generally is desirable for the compositions within the respective layers to form a homogeneous solution with a polymeric binder for forming the particular layer and remain approximately homogeneously distributed through the overcoat layer during the cycling of the material. However, it is unknown whether or not ions within the layers may have transitory movement during the cycling.

In electrophotography applications, a charge generating compound within an organophotoreceptor absorbs light to form electron-hole pairs. These electron-hole pairs can be transported over an appropriate time frame under a large electric field to discharge locally a surface charge that is generating the field. The discharge of the field at a particular location results in a surface charge pattern that essentially matches the pattern drawn with the light. This charge pattern then can be used to guide toner deposition. The charge transport compositions described herein are especially effective at transporting charge, and in particular holes from the electron-hole pairs formed by the charge generating compound. In some embodiments, a specific electron transport compound can also be used along with the charge transport composition.

The layer or layers of materials containing the charge generating compound and the appropriate transport compositions are within an organophotoreceptor. To print a two dimensional image using the organophotoreceptor, the organophotoreceptor has a two dimensional surface for forming at least a portion of the image. The imaging process then continues by cycling the organophotoreceptor to complete the formation of the entire image and/or for the processing of subsequent images. The organophotoreceptor may be provided in the form of a plate, a flexible belt, a disk, a rigid drum, a sheet around a rigid or compliant drum, or the like. The organophotoreceptor may include an electrically conductive substrate and a photoconductive element featuring a charge generating layer.

The organophotoreceptor generally comprises a charge generating material that absorbs light to generate electron and hole pairs. The organophotoreceptor material may further comprise a charge transport compound that is effective for transporting holes, i.e., positive charge carriers. In some embodiments, the organophotoreceptor material has a single layer with both a charge transport composition and a charge generating compound within a polymeric binder. In further embodiments, a charge generating compound is in a charge transport layer distinct from the charge generating layer. Alternatively, the charge generating layer may be intermediate between the charge transport layer and the electrically conductive substrate.

The organophotoreceptors can be incorporated into an electrophotographic imaging apparatus, such as laser printers. In these devices, an image is formed from physical embodiments and converted to a light image that is scanned onto the organophotoreceptor to form a surface latent image. The surface latent image can be used to attract toner onto the surface of the organophotoreceptor, in which the toner image is the same or the negative of the light image projected onto the organophotoreceptor. The toner can be a liquid toner or a dry toner. The toner is subsequently transferred, from the surface of the organophotoreceptor, to a receiving surface, such as a sheet of paper. After the transfer of the toner, the entire surface is discharged, and the material is ready to cycle again. The imaging apparatus can further comprise, for example, a plurality of support rollers for transporting a paper receiving medium and/or for movement of the photoreceptor, suitable optics to form the light image, a light source, such as a laser, a toner source and delivery system and an appropriate control system.

An electrophotographic imaging process generally can comprise (a) applying an electrical charge to a surface of the above-described organophotoreceptor; (b) imagewise exposing the surface of the organophotoreceptor to radiation to dissipate charge in selected areas and thereby form a pattern of charged and uncharged areas on the surface; (c)

exposing the surface with a toner, such as a liquid toner that includes a dispersion of colorant particles in an organic liquid, to attract toner to the charged or discharged regions of the organophotoreceptor to create a toned image; and (d) transferring the toned image to a substrate.

In describing chemicals by structural formulae and group definitions, certain terms are used in a nomenclature format that is chemically acceptable. The terms groups, moiety, and derivatives have specific meanings. The term group indicates that the generically recited chemical material (e.g., alkyl group, stilbenyl group, phenyl group, etc.) may have any substituent thereon which is consistent with the bond structure of that group. For example, alkyl group includes alkyl materials such as methyl ethyl, propyl iso-octyl, dodecyl and the like, and also includes such substituted alkyls such as chloromethyl, dibromoethyl, 1,3-dicyanopropyl, 1,3,5-trihydroxyhexyl, 1,3,5-trifluorocyclohexyl, 1-methoxydodecyl, phenylpropyl and the like. However, as is consistent with such nomenclature, no substitution would be included within the term that would alter the fundamental bond structure of the underlying group. For example, where a stilbenyl group is recited, substitution such as 3-methylstilbenyl would be acceptable within the terminology, while substitution of 3,3-dimethylstilbenyl would not be acceptable as that substitution would require the ring bond structure of one of the phenyl group to be altered to a non-aromatic form because of the substitution.

Where the term moiety is used, such as alkyl moiety or phenyl moiety, that terminology indicates that the chemical material is not substituted. For example, the term alkyl moiety represents only an unsubstituted alkyl hydrocarbon group, whether branched, straight chain, or cyclic. Where the term derivative is used, that terminology indicates that a compound is derived or obtained from another and containing essential elements of the parent substance.

Organophotoreceptors

The organophotoreceptor may be, for example, in the form of a plate, a sheet, a flexible belt, a disk, a rigid drum, or a sheet around a rigid or compliant drum, with flexible belts and rigid drums generally being used in commercial embodiments. The organophotoreceptor may comprise, for example, an electrically conductive substrate and on the electrically conductive substrate a photoconductive element in the form of one or more layers. The photoconductive element can further comprise one or more overcoats or undercoats with respect to a charge generating layer. In some embodiments of particular interest, an overcoat layer comprises a salt, such as an inorganic salt, within a polymer binder.

The photoconductive element can comprise both a charge transport compound and a charge generating compound in a polymeric binder, which may or may not be in the same layer, as well as an electron transport compound in some embodiments. For example, the charge transport compound and the charge generating compound can be in a single layer. In other embodiments, however, the photoconductive element comprises a bilayer construction featuring a charge generating layer and a separate charge transport layer. The charge generating layer may be located intermediate between the electrically conductive substrate and the charge transport layer. Alternatively, the photoconductive element may have a structure in which the charge transport layer is intermediate between the electrically conductive substrate and the charge generating layer.

The electrically conductive substrate may be flexible, for example in the form of a flexible web or a belt, or inflexible, for example in the form of a drum. A drum can have a hollow cylindrical structure that provides for attachment of the drum to a drive that rotates the drum during the imaging process. Typically, a flexible electrically conductive substrate comprises an electrically insulating substrate and a thin layer of electrically conductive material onto which the photoconductive material is applied.

The electrically insulating substrate may be paper or a film forming polymer such as polyester (e.g., polyethylene terepthalate or polyethylene naphthalate), polyimide, polysulfone, polypropylene, nylon, polyester, polycarbonate, polyvinyl resin, polyvinyl fluoride, polystyrene and the like. Specific examples of polymers for supporting substrates included, for example, polyethersulfone (Stabar™ S-100, available from ICI), polyvinyl fluoride (Tedlar™, available from E.I. DuPont de Nemours & Company), polybisphenol-A polycarbonate (Makrofol™, available from Mobay Chemical Company) and amorphous polyethylene terephthalate (Melinar™, available from ICI Americas, Inc.). The electrically conductive materials may be graphite, dispersed carbon black, iodide, conductive polymers such as polypyroles and Calgon® conductive polymer 261 (commercially available from Calgon Corporation, Inc., Pittsburgh, Pa.), metals such as aluminum, titanium, chromium, brass, gold, copper, palladium, nickel, or stainless steel, or metal oxide such as tin oxide or indium oxide. In embodiments of particular interest, the electrically conductive material is aluminum. Generally, the photoconductor substrate has a thickness adequate to provide the required mechanical stability. For example, flexible web substrates generally have a thickness from about 0.01 to about 1 mm, while drum substrates generally have a thickness of from about 0.5 mm to about 2 mm.

The charge generating compound is a material which is capable of absorbing light to generate charge carriers, such as a dye or pigment. Non-limiting examples of suitable charge generating compounds include, for example, metal-free phthalocyanines (e.g., ELA 8034 metal-free phthalocyanine available from H.W. Sands, Inc. or Sanyo Color Works, Ltd., CGM-X01), metal phthalocyanines such as titanium phthalocyanine, copper phthalocyanine, oxytitanium phthalocyanine (also referred to as titanyl oxyphthalocyanine, and including any crystalline phase or mixtures of crystalline phases that can act as a charge generating compound), hydroxygallium phthalocyanine, squarylium dyes and pigments, hydroxy-substituted squarylium pigments, perylimides, polynuclear quinones available from Allied Chemical Corporation under the tradename Indofast® Double Scarlet, Indofast® Violet Lake B, Indofast® Brilliant Scarlet and Indofast® Orange, quinacridones available from DuPont under the tradename Monastral™ Red, Monastral™ Violet and Monastral™ Red Y, naphthalene 1,4,5,8-tetracarboxylic acid derived pigments including the perinones, tetrabenzoporphyrins and tetranaphthaloporphyrins, indigo- and thioindigo dyes, benzothioxanthene-derivatives, perylene 3,4,9,10-tetracarboxylic acid derived pigments, polyazo-pigments including bisazo-, trisazo- and tetrakisazo-pigments, polymethine dyes, dyes containing quinazoline groups, tertiary amines, amorphous selenium, selenium alloys such as selenium-tellurium, selenium-tellurium-arsenic and selenium-arsenic, cadmium sulphoselenide, cadmium selenide, cadmium sulphide, and mixtures thereof. For some embodiments, the charge generating compound comprises oxytitanium phthalocyanine (e.g., any phase thereof), hydroxygallium phthalocyanine or a combination thereof.

There are many kinds of charge transport compound available for electrophotography. For organophotoconductors described herein, any charge transport compound known in the art can be used. Suitable charge transport compounds include, but are not limited to, pyrazoline derivatives, fluorene derivatives, oxadiazole derivatives, stilbene derivatives, hydrazone derivatives, carbazole hydrazone derivatives, triaryl amines, polyvinyl carbazole, polyvinyl pyrene, polyacenaphthylene, or multi-hydrazone compounds comprising at least two hydrazone groups and at least two groups selected from the group consisting of triphenylamine and heterocycles such as carbazole, julolidine, phenothiazine, phenazine, phenoxazine, phenoxathiin, thiazole, oxazole, isoxazole, dibenzo(1,4)dioxine, thianthrene, imidazole, benzothiazole, benzotriazole, benzoxazole, benzimidazole, quinoline, isoquinoline, quinoxaline, indole, indazole, pyrrol, purine, pyridine, pyridazine, pyrimidine, pyrazine, triazole, oxadiazole, tetrazole, thiadiazole, benzisoxazole, benzisothiazole, dibenzofuran, dibenzothiophene, thiophene, thianaphthene, quinazoline, or cinnoline. In some embodiments, the charge transport compound is a stilbene derivative such as MPCT-10, MPCT-38, and MPCT-46 from Mitsubishi Paper Mills (Tokyo, Japan).

In some embodiments, the photoconductive layer of this invention may contain an electron transport compound. Generally, any electron transport compound known in the art can be used. Non-limiting examples of suitable electron transport compound include, for example, bromoaniline, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrohioxanthone, 2,6,8-trinitro-indeno4H-indeno[1,2-b]thiophene-4-one, and 1,3,7-trinitrodibenzothiophene-5,5-dioxide, (2,3-diphenyl-1-indenylidene)malononitrile, 4H-thiopyran-1,1-dioxide and its derivatives such as 4-dicyanomethylene-2,6-diphenyl-4H-thiopyran-1,1-dioxide, 4-dicyanomethylene-2,6-di-m-tolyl-4H-thiopyran-1,1-dioxide, and unsymmetrically substituted 2,6-diaryl-4H-thiopyran-1,1-dioxide such as 4H-1,1-dioxo-2-(p-isopropylphenyl)-6-phenyl-4-(dicyanomethylidene)thiopyran and 4H-1,1-dioxo-2-(p-isopropylphenyl)-6-(2-thienyl)-4-(dicyanomethylidene) thiopyran, derivatives of phospha-2,5-cyclohexadiene, (alkoxycarbonyl-9-fluorenylidene)malononitrile derivatives such as (4-n-butoxycarbonyl-9-fluorenylidene)malononitrile, (4-phenethoxycarbonyl-9-fluorenylidene)malononitrile, (4-carbitoxy-9-fluorenylidene)malononitrile, and diethyl(4-n-butoxycarbonyl-2,7-dinitro-9-fluorenylidene)-malonate, anthraquino dimethane derivatives such as 11,11,12,12-tetracyano-2-alkylanthraquinodimethane and 11,11-dicyano-12,12-bis(ethoxycarbonyl)anthraquinodimethane, anthrone derivatives such as 1-chloro-10-[bis(ethoxycarbonyl)methylene]anthrone, 1,8-dichloro-10-[bis(ethoxycarbonyl) methylene]anthrone, 1,8-dihydroxy-10-[bis(ethoxycarbonyl) methylene]anthrone, and 1-cyano-10-[bis (ethoxycarbonyl)methylene)anthrone, 7-nitro-2-aza-9-fluroenylidene-malononitrile, diphenoquinone derivatives, benzoquinone derivatives, naphtoquinone derivatives, quinine derivatives, tetracyanoethylene, 2,4,8-trinitrothioxantone, dinitrobenzene derivatives, dinitroanthracene derivatives, dinitroacridine derivatives, nitroanthraquinone derivatives, dinitroanthraquinone derivatives, succinic anhydride, maleic anhydride, dibromo maleic anhydride, pyrene derivatives, carbazole derivatives, hydrazone derivatives, N,N-dialkylaniline derivatives, diphenylamine derivatives, triphenylamine derivatives, triphenylmethane derivatives, tetracyanoquinoedimethane, 2,4,5,7-tetranitro-9-fluorenone, 2,4,7-trinitro-9-dicyanomethylenefluorenone, 2,4,5,7-tetranitroxanthone derivatives, and 2,4,8-trinitrothioxanthone derivatives. In some embodiments of interest, the electron transport compound comprises an (alkoxycarbonyl-9-fluorenylidene)malononitrile derivative, such as (4-n-butoxycarbonyl-9-fluorenylidene)malononitrile, (4-phenethoxycarbonyl-9-fluorenylidene)malononitrile, (4-carbitoxy-9-fluorenylidene)malononitrile, and diethyl(4-n-butoxycarbonyl-2,7-dinitro-9-fluorenylidene)-malonate.

An electron transport compound and a UV light stabilizer can have a synergistic relationship for providing desired electron flow within the photoconductor. The presence of the UV light stabilizers alters the electron transport properties of the electron transport compounds to improve the electron transporting properties of the composite. UV light stabilizers can be ultraviolet light absorbers or ultraviolet light inhibitors that trap free radicals.

UV light absorbers can absorb ultraviolet radiation and dissipate it as heat. UV light inhibitors are thought to trap free radicals generated by the ultraviolet light and after trapping of the free radicals, subsequently to regenerate active stabilizer moieties with energy dissipation. In view of the synergistic relationship of the UV stabilizers with electron transport compounds, the particular advantages of the UV stabilizers may not be their UV stabilizing abilities, although the UV stabilizing ability may be further advantageous in reducing degradation of the organophotoreceptor over time. While not wanting to be limited by theory, the synergistic relationship contributed by the UV stabilizers may be related to the electronic properties of the compounds, which contribute to the UV stabilizing function, by further contributing to the establishment of electron conduction pathways in combination with the electron transport compounds. In particular, the organophotoreceptors with a combination of the electron transport compound and the UV stabilizer can demonstrate a more stable acceptance voltage $V_{acc}$ with cycling. The improved synergistic performance of organophotoreceptors with layers comprising both an electron transport compound and a UV stabilizer are described further in copending U.S. patent application Ser. No. 10/425,333 filed on Apr. 28, 2003 to Zhu, entitled "Organophotoreceptor With A Light Stabilizer," incorporated herein by reference.

Non-limiting examples of suitable light stablizer include, for example, hindered trialkylamines such as Tinuvin 144 and Tinuvin 292 (from Ciba Specialty Chemicals, Terrytown, N.Y.), hindered alkoxydialkylamines such as Tinuvin 123 (from Ciba Specialty Chemicals), benzotriazoles such as Tinuvan 328, Tinuvin 900 and Tinuvin 928 (from Ciba Specialty Chemicals), benzophenones such as Sanduvor 3041 (from Clariant Corp., Charlotte, N.C.), nickel compounds such as Arbestab (from Robinson Brothers Ltd, West Midlands, Great Britain), salicylates, cyanocinnamates, benzylidene malonates, benzoates, oxanilides such as Sanduvor VSU (from Clariant Corp., Charlotte, N.C.), triazines such as Cyagard UV-1164 (from Cytec Industries Inc., N.J.), polymeric sterically hindered amines such as Luchem (from Atochem North America, Buffalo, N.Y.). In some embodiments, the light stabilizer is selected from the group consisting of hindered trialkylamines having the following formula:

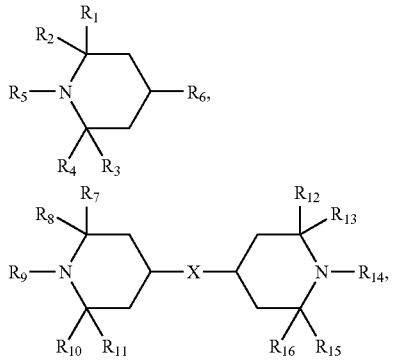

where $R_1$, $R_2$, $R_3$, $R_4$, $R_6$, $R_7$, $R_8$, $R_{10}$, $R_{11}$, $R_{12}$, $R_{13}$, $R_{14}$, $R_{15}$ are, independently, hydrogen, alkyl group, or ester, or ether group; and $R_5$, $R_9$, and $R_{14}$ are, independently, alkyl group; and X is a linking group selected from the group consisting of —O—CO—$(CH_2)_m$—CO—O— where m is between 2 to 20.

The binder generally is capable of dispersing or dissolving the charge transport compound (in the case of the charge transport layer or a single layer construction), the charge generating compound (in the case of the charge generating layer or a single layer construction) and/or an electron transport compound for appropriate embodiments. Examples of suitable binders for both the charge generating layer and charge transport layer generally include, for example, polystyrene-co-butadiene, polystyrene-co-acrylonitrile, modified acrylic polymers, polyvinyl acetate, styrene-alkyd resins, soya-alkyl resins, polyvinylchloride, polyvinylidene chloride, polyacrylonitrile, polycarbonates, polyacrylic acid, polyacrylates, polymethacrylates, styrene polymers, polyvinyl butyral, alkyd resins, polyamides, polyurethanes, polyesters, polysulfones, polyethers, polyketones, phenoxy resins, epoxy resins, silicone resins, polysiloxanes, poly(hydroxyether) resins, polyhydroxystyrene resins, novolak, poly(phenylglycidyl ether)-co-dicyclopentadiene, copolymers of monomers used in the above-mentioned polymers, and combinations thereof. In some embodiments, polycarbonate binders and/or polyvinyl butyral binders are of particular interest. Examples of suitable polycarbonate binders include, for example, polycarbonate A which is derived from bisphenol-A, polycarbonate Z, which is derived from cyclohexylidene bisphenol, polycarbonate C, which is derived from methylbisphenol A, and polyestercarbonates. Suitable polyvinyl butyral binders include, for example, BX-1 and BX-5 form Sekisui Chemical Co. Ltd., Japan.

Suitable optional additives for any one or more of the layers include, for example, antioxidants, coupling agents, dispersing agents, curing agents, surfactants and combinations thereof.

The photoconductive element overall typically has a thickness from about 10 to about 45 microns and in some embodiments from about 12 microns to about 40 microns. In the dual layer embodiments having a separate charge generating layer and a separate charge transport layer, charge generation layer generally has a thickness form about 0.5 to about 2 microns, and the charge transport layer has a thickness from about 5 to about 35 microns. In embodiments in which the charge transport compound and the charge generating compound are in the same layer, the layer with the charge generating compound and the charge transport composition generally has a thickness from about 7 to about 30 microns. In embodiments with a distinct electron transport layer, the electron transport layer has an average thickness from about 0.5 microns to about 10 microns and in further embodiments from about 1 micron to about 3 microns. In general, an electron transport overcoat layer can increase mechanical abrasion resistance, increases resistance to carrier liquid and atmospheric moisture, and decreases degradation of the photoreceptor by corona gases. A person of ordinary skill in the art will recognize that additional ranges of thickness within the explicit ranges above are contemplated and are within the present disclosure.

Generally, for the organophotoreceptors described herein, the charge generation compound is in an amount from about 0.5 to about 25 weight percent in further embodiments in an amount from about 1 to about 15 weight percent and in other embodiments in an amount from about 2 to about 10 weight percent, based on the weight of the photoconductive layer. The charge transport compound is in an amount from about 10 to about 80 weight percent, based on the weight of the photoconductive layer, in further embodiments in an amount from about 35 to about 60 weight percent, and in other embodiments from about 45 to about 55 weight percent, based on the weight of the photoconductive layer. The optional electron transport compound, when present, can be in an amount of at least about 2 weight percent, in other embodiments from about 2.5 to about 25 weight percent, based on the weight of the photoconductive layer, and in further embodiments in an amount from about 4 to about 20 weight percent, based on the weight of the photoconductive layer. The binder is in an amount from about 15 to about 80 weight percent, based on the weight of the photoconductive layer, and in further embodiments in an amount from about 20 to about 75 weight percent, based on the weight of the photoconductive layer. A person of ordinary skill in the art will recognize that additional ranges within the explicit ranges of compositions are contemplated and are within the present disclosure.

For the dual layer embodiments with a separate charge generating layer and a charge transport layer, the charge generation layer generally comprises a binder in an amount from about 10 to about 90 weight percent, in further embodiments from about 15 to about 80 weight percent and in some embodiments in an amount of from about 20 to about 75 weight percent, based on the weight of the charge generation layer. The optional electron transport compound in the charge generating layer, if present, generally can be in an amount of at least about 2.5 weight percent, in further embodiments from about 4 to about 30 weight percent and in other embodiments in an amount from about 10 to about 25 weight percent, based on the weight of the charge generating layer. The charge transport layer generally comprises a binder in an amount from about 20 weight percent to about 70 weight percent and in further embodiments in an amount from about 30 weight percent to about 50 weight percent. A person of ordinary skill in the art will recognize that additional ranges of binder concentrations for the dual layer embodiments within the explicit ranges above are contemplated and are within the present disclosure.

For the embodiments with a single layer having a charge generating compound and a charge transport compound, the photoconductive layer generally comprises a binder, a charge transport compound and a charge generation compound. The charge generation compound can be in an amount from about 0.05 to about 25 weight percent and in further embodiment in an amount from about 2 to about 15 weight percent, based on the weight of the photoconductive layer. The charge transport compound can be in an amount from about 10 to about 80 weight percent, in other embodiments from about 25 to about 65 weight percent, in additional embodiments from about 30 to about 60 weight percent and in further embodiments in an amount of from about 35 to about 55 weight percent, based on the weight of the photoconductive layer, with the remainder of the photoconductive layer comprising the binder, and optionally additives, such as any conventional additives. A single layer with a charge transport composition and a charge generating compound generally comprises a binder in an amount from about 10 weight percent to about 75 weight percent, in other embodiments from about 20 weight percent to about 60 weight percent, and in further embodiments from about 25 weight percent to about 50 weight percent. Optionally, the layer with the charge generating compound and the charge transport compound may comprise an electron transport compound. The optional electron transport compound, if present, generally can be in an amount of at least about 2.5 weight percent, in further embodiments from about 4 to about 30 weight percent and in other embodiments in an amount from about 10 to about 25 weight percent, based on the weight of the photoconductive layer. A person of ordinary skill in the art will recognize that additional composition ranges within the explicit compositions ranges for the layers above are contemplated and are within the present disclosure.

In general, any layer with an electron transport layer can advantageously further include a UV light stabilizer. In particular, the electron transport layer generally can comprise an electron transport compound, a binder and an optional UV light stabilizer. An overcoat layer comprising an electron transport compound is described further in copending U.S. patent application Ser. No. 10/396,536 to Zhu et al. entitled, "Organophotoreceptor With An Electron Transport Layer," incorporated herein by reference. For example, an electron transport compound as described above may be used in the release layer of the photoconductors described herein. The electron transport compound in an electron transport layer can be in an amount from about 10 to about 50 weight percent, and in other embodiments in an amount from about 20 to about 40 weight percent, based on the weight of the electron transport layer. A person of ordinary skill in the art will recognize that additional ranges of compositions within the explicit ranges are contemplated and are within the present disclosure.

The UV light stabilizer, if present, in any of one or more appropriate layers of the photoconductor generally is in an amount from about 0.5 to about 25 weight percent and in some embodiments in an amount from about 1 to about 10 weight percent, based on the weight of the particular layer. A person of ordinary skill in the art will recognize that additional ranges of compositions within the explicit ranges are contemplated and are within the present disclosure.

For example, the photoconductive layer may be formed by dispersing or dissolving the components, such as one or more of a charge generating compound, a charge transport compound, an electron transport compound, a UV light stabilizer, and a polymeric binder in organic solvent, coating the dispersion and/or solution on the respective underlying layer and drying the coating. In particular, the components can be dispersed by high shear homogenization, ball-milling, attritor milling, high energy bead (sand) milling or other size reduction processes or mixing means known in the art for effecting particle size reduction in forming a dispersion. For photoconductive elements with multiple layers, generally the layers can be applied sequentially to form the desired structure.

The photoreceptor may optionally have one or more additional layers as well. An additional layer can be, for example, a sub-layer or an overcoat layer, such as a barrier layer, a release layer, a protective layer, or an adhesive layer. A release layer or a protective layer may form the uppermost layer of the photoconductor element. A barrier layer may be sandwiched between the release layer and the photoconductive element or used to overcoat the photoconductive element. The barrier layer provides protection from abrasion to the underlayers. An adhesive layer locates and improves the adhesion between a photoconductive element, a barrier layer and a release layer, or any combination thereof. A sub-layer is a charge blocking layer and locates between the electrically conductive substrate and the photoconductive element. The sub-layer may also improve the adhesion between the electrically conductive substrate and the photoconductive element.

The improved overcoat layers described herein are based on the discovery that the addition of an ionic salt to an overcoat layer having a binder with an unacceptable conductivity reduces $V_{dis}$ of organophotoreceptors having such an overcoat. Suitable ionic salts, such as inorganic salts, include salts comprising a cation and an anion. Non-limiting examples of suitable cations include $NH_4^+$, $K^+$, $Li^+$, $Na^+$, $Rb^+$, $Cs^+$, $Ca^{+2}$, $Mg^{+2}$, $Sr^{+2}$, $Ba^{+2}$, $Al^{+3}$, $Co^{+2}$, $Ni^{+2}$, $Cu^{+2}$, and $Zn^{+2}$. Non-limiting examples of suitable anions include $F^-$, $Cl^-$, $Br^-$, $I^-$, $NO_3^-$, $SO_4^{-2}$, and $ClO_4^-$. Suitable ionic salts comprise a cation, such as lithium cation and sodium cation, with a small ionic radius, and an anion with a large ionic radius. An overcoat layer with an inorganic salt generally can have a thickness from about 0.1 microns to about 20 microns, in other embodiments from about 0.5 microns to about 15 microns and in further embodiments, from about 1 micron to about 10 microns. A person of ordinary skill in the art will recognize that additional ranges within the explicit ranges of overcoat thickness are contemplated and are within the present disclosure.

The results described below suggest perhaps that multiple properties influence the effectiveness of the ionic salt in lowering the value of $V_{dis}$. While not wanting to be limited by theory, some general observations can be made with respect to a organophotoconductor that operates with a positive surface charge. The lowering of the value of $V_{dis}$ involves the transportation of electrons from the photoconductive material through the overcoat to the surface, or similarly the conduction of holes, i.e., positive charge carriers, from the surface through the overcoat. To the extent that the presence of the ionic salt influences this process, the salt facilitates the transport of electrons or holes. In general, the presence of cations can attract electrons to their vicinity, and anions can attract holes to their vicinity or ionize to form an electron and the atomic state. The size of the ions, i.e., the ionic radius, can influence the strength of ionic bonding, which in turn can influence the distribution of ions within the layer after forming the overcoat. On the other hand, the ionic radius as well as the nuclear charge can further correlate with the electronic properties, such as ionization energies/electron affinities. The ionization energies and electron affinities would likely also influence the ability to assist with electron and/or hole migration. Thus, smaller anions may have lower electron affinities, such that they can transport their electrons through the layer and subsequently accept an electron to reform the anion. Smaller cations may have higher electron affinities to draw electrons into the overcoat from the underlying layers.

Ionic radii are dependent on the approach used to evaluate the radii. Trends of ionic radii values generally are independent of the approach to evaluate the values, and any uniform approach is suitable for present descriptions. As used herein, the ionic radii are Pauling radii as described in the Nature of the Chemical Bond, L. Pauling, 3rd edition, (1960), incorporated herein by reference. For polynuclear ions, the radii can be appropriate apparent values termed thermochemical values. In general, in some embodiments, the cations have a ionic radius of no more than 1 Angstrom, and the anions have an ionic radius of at least about 1.8 Angstroms.

The ionic salt in the overcoat layer is in an amount of from about 0.5 to about 50 weight percent, preferably in an amount of from about 1 to about 30 weight percent, and more preferably in an amount of from about 5 to 20 weight percent based on the weight of the overcoat layer. A person of ordinary skill in the art will recognize that additional ranges within the explicit ranges of salt concentration are contemplated and are within the present disclosure.

The binder for the overcoat layer may be, for example, polymers such as fluorinated polymer, siloxane polymer, fluorosilicone polymer, silane, polyethylene, polypropylene, polyacrylate, poly(methyl methacrylate-co-methacrylic acid), urethane resin, urethane-epoxy resin, acrylated-urethane resin, urethane-acrylic resin, epoxy resins, or a combination thereof. In some embodiments, the binder is an organic polymer, and in other embodiments, the binder is a polymer that is not silsesquioxane. The above binders may be solvent-based or water-based. In some embodiments, overcoat binders are water-based or waterborne polymeric binder. Non-limiting examples of water-based polymeric binders suitable for the overcoats described herein are polyurethanes such as Andura™-50, -100, and -200 from Air Products, Shakopee, Minn. 55379, urethane-acrylic resin such as Hybridur™-560, -570, and -580 from Air Products, epoxy resin such as Ancarez™ AR 550 from Air Products, and Beckopox™ from Solutia Inc., St. Louis, Mo. The overcoat binders of particular interest comprise water-based polyurethane. However, most of the above polymer binders have low electrical conductivity and thus provide high $V_{dis}$, when unmodified.

Suitable barrier layers include, for example, coatings such as crosslinkable siloxanol-colloidal silica coating and hydroxylated silsesquioxane-colloidal silica coating, and organic binders such as polyvinyl alcohol, methyl vinyl ether/maleic anhydride copolymer, casein, polyvinyl pyrrolidone, polyacrylic acid, gelatin, starch, polyurethanes, polyimides, polyesters, polyamides, polyvinyl acetate, polyvinyl chloride, polyvinylidene chloride, polycarbonates, polyvinyl butyral, polyvinyl acetoacetal, polyvinyl formal, polyacrylonitrile, polymethyl methacrylate, polyacrylates, polyvinyl carbazoles, copolymers of monomers used in the above-mentioned polymers, vinyl chloride/vinyl acetate/vinyl alcohol terpolymers, vinyl chloride/vinyl acetate/maleic acid terpolymers, ethylene/vinyl acetate copolymers, vinyl chloride/vinylidene chloride copolymers, cellulose polymers, and mixtures thereof. The above barrier layer polymers optionally may contain small inorganic particles such as fumed silica, silica, titania, alumina, zirconia, or a combination thereof. Barrier layers are described further in U.S. Pat. No. 6,001,522 to Woo et al., entitled "Barrier Layer For Photoconductor Elements Comprising An Organic Polymer And Silica," incorporated herein by reference. The release layer topcoat may comprise any release layer composition known in the art. In some embodiments, the release layer is a fluorinated polymer, siloxane polymer, fluorosilicone polymer, silane, polyethylene, polypropylene, polyacrylate, or a combination thereof. The release layers can comprise crosslinked polymers.

The release layer may comprise, for example, any release layer composition known in the art. In some embodiments, the release layer comprises a fluorinated polymer, siloxane polymer, fluorosilicone polymer, polysilane, polyethylene, polypropylene, polyacrylate, poly(methyl methacrylate-co-methacrylic acid), urethane resins, urethane-epoxy resins, acrylated-urethane resins, urethane-acrylic resins, or a combination thereof. In further embodiments, the release layers comprise crosslinked polymers.

The protective layer can protect the organophotoreceptor from chemical and mechanical degradation. The protective layer may comprise any protective layer composition known in the art. In some embodiments, the protective layer is a fluorinated polymer, siloxane polymer, fluorosilicone polymer, polysilane, polyethylene, polypropylene, polyacrylate, poly(methyl methacrylate-co-methacrylic acid), urethane resins, urethane-epoxy resins, acrylated-urethane resins, urethane-acrylic resins, or a combination thereof. In some embodiments of particular interest, the release layers are crosslinked polymers.

An overcoat layer may comprise an electron transport compound as described further in copending U.S. patent application Ser. No. 10/396,536, filed on Mar. 25, 2003 to Zhu et al. entitled, "Organoreceptor With An Electron Transport Layer," incorporated herein by reference. For example, an electron transport compound, as described above, may be used in the release layer of this invention. The electron transport compound in the overcoat layer can be in an amount from about 1 to about 50 weight percent, in some embodiments in an amount from about 2 to about 40 weight percent, in additional embodiments from about 5 to about 30 weight percent, and in other embodiments in an amount from about 10 to about 20 weight percent, based on the weight of the release layer. A person of ordinary skill in the art will recognize that additional ranges of composition within the explicit ranges are contemplated and are within the present disclosure.

Generally, adhesive layers comprise a film forming polymer, such as polyester, polyvinylbutyral, polyvinylpyrolidone, polyurethane, polymethyl methacrylate, poly(hydroxy amino ether) and the like.

Sub-layers can comprise, for example, polyvinylbutyral, organosilanes, hydrolyzable silanes, epoxy resins, polyesters, polyamides, polyurethanes, silicones and the like. In some embodiments, the sub-layer has a dry thickness between about 20 Angstroms and about 2,000 Angstroms. Sublayers containing metal oxide conductive particles can be between about 1 and about 25 microns thick. A person of ordinary skill in the art will recognize that additional ranges of compositions and thickness within the explicit ranges are contemplated and are within the present disclosure.

The charge transport compounds as described herein, and photoreceptors including these compounds, are suitable for use in an imaging process with either dry or liquid toner development. For example, any dry toners and liquid toners known in the art may be used in the process and the apparatus of this invention. Liquid toner development can be desirable because it offers the advantages of providing higher resolution images and requiring lower energy for image fixing compared to dry toners. Examples of suitable liquid toners are known in the art. Liquid toners generally comprise toner particles dispersed in a carrier liquid. The toner particles can comprise a colorant/pigment, a resin binder, and/or a charge director. In some embodiments of liquid toner, a resin to pigment ratio can be from 1:1 to 10:1, and in other embodiments, from 4:1 to 8:1. Liquid toners are described further in Published U.S. Patent Applications 2002/0128349, entitled "Liquid Inks Comprising A Stable Organosol," 2002/0086916, entitled "Liquid Inks Comprising Treated Colorant Particles," and 2002/0197552, entitled "Phase Change Developer For Liquid Electrophotography," all three of which are incorporated herein by reference.

The invention will now be described further by way of the following examples.

EXAMPLES

Example 1

Preparation of (4-n-Butoxycarbonyl-9-fluorenylidene) Malononitrile

This example describes the preparation of (4-n-butoxycarbonyl-9-fluorenylidene) malononitrile for use as an electron transport compound.

A 460 g quantity of concentrated sulfuric acid (4.7 moles, analytical grade, commercially obtained from Sigma-Aldrich, Milwaukee, Wis.) and 100 g of diphenic acid (0.41 mole, commercially obtained from Acros Fisher Scientific Company Inc., Hanover Park, Ill.) were added to a 1-liter 3-neck round bottom flask, equipped with a thermometer, mechanical stirrer and a reflux condenser. Using a heating mantle, the flask was heated to 135–145° C. for 12 minutes, and then cooled to room temperature. After cooling to room temperature, the solution was added to a 4-liter Erlenmeyer flask containing 3 liter of water. The mixture was stirred mechanically and was boiled gently for one hour. A yellow solid was filtered out hot, washed with hot water until the pH of the wash-water was neutral, and dried in the air overnight. The yellow solid was fluorenone-4-carboxylic acid. The yield was 75 g (80%). The product was then characterized. The melting point (m.p.) was found to be 223–224° C. A $^1$H-NMR spectrum of fluorenone-4-carboxylic acid was obtained in $d_6$-DMSO solvent with a 300 MHz NMR from Bruker Instrument. The peaks were found at (ppm) δ=7.39–7.50 (m, 2H), δ=7.79–7.70 (q, 2H), δ=7.74–7.85 (d, 1H), δ=7.88–8.00 (d, 1H), and 6=8.18–8.30 (d, 1H), where d is doublet, t is triplet, m is multiplet; dd is double doublet, q is quintet.

A 70 g (0.312 mole) quantity of fluorenone-4-carboxylic acid, 480 g (6.5 mole) of n-butanol (commercially obtained from Fisher Scientific Company Inc., Hanover Park, Ill.), 1000 ml of toluene and 4 ml of concentrated sulfuric acid were added to a 2-liter round bottom flask equipped with a mechanical stirrer and a reflux condenser with a Dean Stark apparatus. With aggressive agitation and refluxing, the solution was refluxed for 5 hours, during which about 6 g of water were collected in the Dean Stark apparatus. The flask was cooled to room temperature. The solvents were evaporated, and the residue was added, with agitation, to 4 liters of a 3% sodium bicarbonate aqueous solution. The solid was filtered off, washed with water until the pH of the wash-water was neutral, and dried in the hood overnight. The product was n-butyl fluorenone-4-carboxylate ester. The yield was 70 g (80%). A $^1$H-NMR spectrum of n-butyl fluorenone-4-carboxylate ester was obtained in $CDCl_3$ with a 300 MHz NMR from Bruker Instrument. The peaks were found at (ppm) δ=0.87–1.09 (t, 3H), δ=1.42–1.70 (m, 2H), δ=1.75–1.88 (q, 2H), δ=4.26–4.64 (t, 2H), δ=7.29–7.45 (m, 2H), δ=7.46–7.58 (m, 1H), δ=7.60–7.68 (dd, 1H), δ=7.75–7.82 (dd, 1H), δ=7.90–8.00 (dd, 1H), δ=8.25–8.35 (dd, 1H).

A 70 g (0.25 mole) quantity of n-butyl fluorenone-4-carboxylate ester, 750 ml of absolute methanol, 37 g (0.55 mole) of malononitrile (commercially obtained from Sigma-Aldrich, Milwaukee, Wis.), 20 drops of piperidine (commercially obtained from Sigma-Aldrich, Milwaukee, Wis.) were added to a 2-liter, 3-neck round bottom flask equipped with a mechanical stirrer and a reflux condenser. The solution was refluxed for 8 hours, and the flask was cooled to room temperature. The orange crude product was filtered, washed twice with 70 ml of methanol and once with 150 ml of water, and dried overnight in the hood. This orange crude product was recrystallized from a mixture of 600 ml of acetone and 300 ml of methanol using activated charcoal. The flask was placed at 0° C. for 16 hours. The crystals were filtered and dried in a vacuum oven at 50° C. for 6 hours to obtain 60 g of pure (4-n-butoxycarbonyl-9-fluorenylidene) malononitrile. The melting point (m.p.) of the solid was found to be 99–100° C. A $^1$H-NMR spectrum of (4-n-butoxycarbonyl-9-fluorenylidene) malononitrile was obtained in $CDCl_3$ with a 300 MHz NMR from Bruker Instrument. The peaks were found at (ppm) δ=0.74–1.16 (t, 3H), δ=1.38–1.72 (m, 2H), δ=1.70–1.90 (q, 2H), δ=4.29–4.55 (t, 2H), δ=7.31–7.43 (m, 2H), δ=7.45–7.58 (m, 1H), δ=7.81–7.91 (dd, 1H), δ=8.15–8.25 (dd, 1H), δ=8.42–8.52 (dd, 1H), δ=8.56–8.66 (dd, 1H).

Example 2

Preparation of Organophotoreceptor Samples

This example described the preparation of three comparative sample organophotoreceptors and 20 sample organophotoreceptors. These organophotoreceptors are characterized in the following examples.

Comparative Sample A

Comparative Sample A was an organophotoreceptor with a single layer photoconductor having a 76.2 micron (3 mil) thick polyester substrate with a layer of vapor-coated aluminum (commercially obtained from CP Films, Martinsville, Va.). The coating solution for the single layer photoconductor was prepared by pre-mixing 892.5 g of 20% (4-n-butoxycarbonyl-9-fluorenylidene) malononitrile dissolved in tetrahydrofuran (commercially obtained from Aldrich, Milwaukee, Wis.), 2475.2 g of 25% MPCT-10 (a charge transfer compound, commercially obtained from Mitsubishi Paper Mills, Tokyo, Japan) dissolved in tetrahydrofuran, 2128.9 g of 14% polyvinyl butyral resin (BX-1, commercially obtained from Sekisui Chemical Co. Ltd., Japan) dissolved in tetrahydrofuran, 158.67 g of 15% Tinuvin®-292 and 130.9 g of 15% Tinuvin®-928 (both commercially available from Ciba Specialty Chemicals, Inc., Terrytown, N.Y.) dissolved in tetrahydrofuran, and 939.9 g of tetrahydrofuran. A 273.9 g quantity of a CGM mill-base containing 19% titanyl oxyphthalocyanine (commercially obtained from H.W. Sands Corp., Jupiter, Fla.) and a polyvinyl butyral resin (BX-5, commercially obtained from Sekisui Chemical Co. Ltd., Japan) at a weight ratio of 2.3:1 was then added to the coating solution. The CGM mill-base was obtained by milling 112.7 g of the titanyl oxyphthalocyanine (H.W. Sands Corp., Jupiter, Fla.) with 49 g of the polyvinyl butyral resin (BX-5) in 651 g of methylethylketone on a horizontal sand mill (model LMC12 DCMS, commercially obtained from Netzsch Incornorated, Exton, Pa.) with 1-micron zirconium beads using recycle mode for 6 hours. After mixing of all the coating ingredients, the coating solution was filtered through a 40 micron filter. The filtered solution was coated onto the substrate described above by a web coater at a web speed of 10 feet per minute, which was followed by drying in a 20 feet oven at a temperature of 110° C. (i.e., 2 minutes of drying at 110° C.). The dry coating thickness was found to be about 13 microns.

Comparative Sample B

Comparative Sample B had an overcoat layer coated on top of the organophotoreceptor of Comparative Sample A. A premix solution was prepared by premixing 1.0 g of a surfactant BYK®-333 (i.e., a polyether modified poly-dimethyl-siloxane, commercially obtained from BYK®-Chemie USA, Wallingford, Conn.) in 47.4 g of a co-solvent ARCOSOLV® DPNB (i.e., dipropylene glycol normal butyl ether, commercially obtained from Lyondell Chemical, Newtown Square, Pa.). In a separate container, to form the coating solution for the overcoat layer, 71.4 g of Macekote®-8539 (i.e., a water-dispersed polyurethane, commercially obtained from Mace Adhesives & Coatings Co., Inc., Dudley, Mass.) was diluted with 404.8 g of de-ionized water, which was followed by the addition of 24.2 g of the premixed solution. After mixing, the coating solution was coated onto the photoconductive element of Comparative Sample A by using a knife coater with a gap space of 50 micron, which was followed by drying in an oven at 95° C. for 5 minutes.

Comparative Sample C

Comparative Sample C was prepared similarly to Comparative Sample B except that the coating solution for the overcoat had higher percent of solids, and it was coated on the a 76.2 micron (3 mil) thick polyester substrate having a layer of vapor-coated aluminum (commercially obtained from CP Films, Martinsville, Va.). Specifically, the premix solution was prepared by premixing 0.5 g of a surfactant BYK®-333 (i.e., a polyether modified poly-dimethyl-siloxane, commercially obtained from BYK®-Chemie USA, Wallingford, Conn.) in 22.5 g of a co-solvent ARCOSOLV® DPNB (i.e., dipropylene glycol normal butyl ether, commercially obtained from Lyondell Chemical, Newtown Square, Pa.). In a separate container, to form the coating solution, 7.14 g of Macekote®-8539 (i.e., a water-dispersed polyurethane, commercially obtained from Mace Adhesives & Coatings Co., Inc., Dudley, Mass.) was diluted with 16.7 g of de-ionized water, which was followed by adding 1.15 g of the premix solution. The coating thickness was about 3.1 micron measured by using a Fischerscope® Multi Measuring System (Version-Permascope by Fischer Technology, Inc., Windsor, Conn.).

Sample 1

Sample 1 was prepared similarly according to the procedure for Comparative Sample B except that the coating solution for the overcoat layer was prepared by mixing 27.0 g of the coating solution prepared for Comparative Example B with 3.0 g of 5 weight % lithium nitrate (commercially obtained from Aldrich, Milwaukee, Wis.) pre-dissolved in de-ionized water.

Sample 2

Sample 2 was prepared similarly according to the procedure for Sample 1 except that the 5 weight % lithium nitrate solution was replaced by the 5 weight % of sodium nitrate (commercially obtained from Aldrich, Milwaukee, Wis.) pre-dissolved in de-ionized water.

Example 3

Example 3 was prepared similarly according to the procedure for Example 1 except that the 5 weight % lithium nitrate solution was replaced by the 5 weight % of potassium nitrate (commercially obtained from Aldrich, Milwaukee, Wis.) pre-dissolved in de-ionized water.

Sample 4

Sample 4 was prepared similarly according to the procedure for Sample 1 except that the 5 weight % lithium nitrate solution was replaced by the 5 weight % of cesium nitrate (commercially obtained from Aldrich, Milwaukee, Wis.) pre-dissolved in de-ionized water.

Sample 5

Sample 5 was prepared similarly to Comparative Sample C except that the coating solution for the overcoat layer was prepared by diluting 4.0 g of Macekote®-8539 (i.e., a water-dispersed polyurethane, commercially obtained from Mace Adhesives & Coatings Co., Inc., Dudley, Mass.) with 8.2 g of de-ionized water, which was followed by adding 0.3 g of the premix solution plus 3.1 g of 5 weight % lithium nitrate (commercially obtained from Aldrich, Milwaukee, Wis.) pre-dissolved in de-ionized water. The coating thickness was about 3.1 micron measured by using a Fischerscope® Multi Measuring System (Version-Permascope by Fischer Technology, Inc., Windsor, Conn.).

Sample 6

Sample 6 was prepared similarly according to the procedure for Comparative Sample B except that the coating solution for the overcoat layer was prepared by mixing 27.0 g of the coating solution prepared for Comparative Sample B with 3.0 g of 5 weight % lithium perchlorate (commercially obtained from Aldrich, Milwaukee, Wis.) pre-dissolved in de-ionized water.

Sample 7

Sample 7 was prepared similarly according to the procedure for Sample 6 except that the 5 weight % lithium perchlorate solution was replaced by the 5 weight % of sodium perchlorate (commercially obtained from Aldrich, Milwaukee, Wis.) pre-dissolved in de-ionized water.

Sample 8

Sample 8 was prepared similarly according to the procedure for Sample 6 except that the 5 weight % lithium perchlorate solution was replaced by the 5 weight % of potassium perchlorate (commercially obtained from Aldrich, Milwaukee, Wis.) pre-dissolved in de-ionized water.

Sample 9

Sample 9 was prepared similarly according to the procedure for Sample 6 except that the 5 weight % lithium perchlorate solution was replaced by the 5 weight % of cesium perchlorate (commercially obtained from Aldrich, Milwaukee, Wis.) pre-dissolved in de-ionized water.

Sample 10

Sample 10 was prepared similarly according to the procedure for Sample 6 except that the 5 weight % lithium perchlorate solution was replaced by the 5 weight % of sodium fluoride (commercially obtained from Aldrich, Milwaukee, Wis.) pre-dissolved in de-ionized water.

Sample 11

Sample 11 was prepared similarly according to the procedure for Sample 6 except that the 5 weight % lithium perchlorate solution was replaced by the 5 weight % of potassium fluoride (commercially obtained from Aldrich, Milwaukee, Wis.) pre-dissolved in de-ionized water.

Sample 12

Sample 12 was prepared similarly according to the procedure for Sample 6 except that the 5 weight % lithium perchlorate solution was replaced by the 5 weight % of cesium fluoride (commercially obtained from Aldrich, Milwaukee, Wis.) pre-dissolved in de-ionized water.

Sample 13

Sample 13 was prepared similarly according to the procedure for Sample 6 except that the 5 weight % lithium perchlorate solution was replaced by the 5 weight % of sodium chloride (commercially obtained from Aldrich, Milwaukee, Wis.) pre-dissolved in de-ionized water.

Sample 14

Sample 14 was prepared similarly according to the procedure for Sample 6 except that the 5 weight % lithium perchlorate solution was replaced by the 5 weight % of potassium chloride (commercially obtained from Aldrich, Milwaukee, Wis.) pre-dissolved in de-ionized water.

Sample 15

Sample 15 was prepared similarly according to the procedure for Sample 6 except that the 5 weight % lithium perchlorate solution was replaced by the 5 weight % of sodium bromide (commercially obtained from Aldrich, Milwaukee, Wis.) pre-dissolved in de-ionized water.

Sample 16

Sample 16 was prepared similarly according to the procedure for Sample 6 except that the 5 weight % lithium perchlorate solution was replaced by the 5 weight % of potassium bromide (commercially obtained from Aldrich, Milwaukee, Wis.) pre-dissolved in de-ionized water.

Sample 17

Sample 17 was prepared similarly according to the procedure for Sample 6 except that the 5 weight % lithium perchlorate solution was replaced by the 5 weight % of sodium iodide (commercially obtained from Aldrich, Milwaukee, Wis.) pre-dissolved in de-ionized water.

Sample 18

Sample 18 was prepared similarly according to the procedure for Sample 6 except that the 5 weight % lithium perchlorate solution was replaced by the 5 weight % of potassium iodide (commercially obtained from Aldrich, Milwaukee, Wis.) pre-dissolved in de-ionized water.

Sample 19

Sample 19 was prepared similarly according to the procedure for Sample 6 except that the 5 weight % lithium perchlorate solution was replaced by the 5 weight % of lithium bromide (commercially obtained from Aldrich, Milwaukee, Wis.) pre-dissolved in de-ionized water.

Sample 20

Sample 20 was prepared similarly according to the procedure for Sample 6 except that the 5 weight % lithium perchlorate solution was replaced by the 5 weight % of lithium iodide (commercially obtained from Aldrich, Milwaukee, Wis.) pre-dissolved in de-ionized water.

Example 3

Electrostatic Testing

This example provides results of electrostatic testing on the organophotoreceptor samples formed as described in Example 2.

Electrostatic cycling performance of organophotoreceptors described herein with overcoats comprising salt was determined using in-house designed and developed test bed that can test, for example, up to three sample strips wrapped around a 160 mm diameter drum. The results on these samples are indicative of results that would be obtained with other support structures, such as belts, drums and the like, for supporting the organophotoreceptors.

For testing using a 160 mm diameter drum, three coated sample strips, each measuring 50 cm long by 8.8 cm wide, were fastened side-by-side and completely around an aluminum drum (50.3 cm circumference). In some embodiments, at least one of the strips is a control sample that is precision web coated and used as an internal reference point. A control sample with an inverted dual layer structure was used as an internal check of the tester. In this electrostatic cycling tester, the drum rotated at a rate of 8.13 cm/sec (3.2 ips), and the location of each station in the tester (distance and elapsed time per cycle) is given as shown in the following table:

TABLE 1

Electrostatic test stations around the 160 mm diameter drum at 8.13 cm/sec.

| Station | Degrees | Total Distance, cm | Total Time, sec |
|---|---|---|---|
| Front erase bar edge | 0° | Initial, 0 cm | Initial, 0 s |
| Erase Bar | 0–7.2° | 0–1.0 | 0–0.12 |
| Scorotron Charger | 113.1–135.3° | 15.8–18.9 | 1.94–2.33 |
| Laser Strike | 161.0° | 22.5 | 2.77 |
| Probe #1 | 181.1° | 25.3 | 3.11 |
| Probe #2 | 251.2° | 35.1 | 4.32 |
| Erase bar | 360° | 50.3 | 6.19 |

The erase bar is an array of laser emitting diodes (LED) with a wavelength of 720 nm that discharges the surface of the organophotoreceptor. The scorotron charger comprises a wire that permits the transfer of a desired amount of charge to the surface of the organophotoreceptor.

From the above table, the first electrostatic probe (Trek 344™ electrostatic meter, Trek, Inc. Medina, N.Y.) is located 0.34 s after the laser strike station and 0.78 s after the scorotron while the second probe (Trek™ 344 electrostatic meter) is located 1.21 s from the first probe and 1.99 s from the scorotron. All measurements are performed at ambient temperature and relative humidity.

Electrostatic measurements were obtained as a compilation of several runs on the test station. The first three diagnostic tests (prodtest initial, VlogE initial, dark decay initial) were designed to evaluate the electrostatic cycling of a new, fresh sample and the last three, identical diagnostic test (prodtest final, VlogE final, dark decay final) are run after cycling of the sample. In addition, measurements were made periodically during the test, as described under "long-grun" below. The laser is operated at 780 nm wavelength, 600 dpi, 50 micron spot size, 60 nanoseconds/pixel expose time, 1,800 lines per second scan speed, and a 100% duty cycle. The duty cycle is the percent exposure of the pixel clock period, i.e., the laser is on for the full 60 nanoseconds per pixel at a 100% duty cycle.

Electrostatic Test Suite:

1) PRODTEST: The erase bar was turned on during this diagnostic test and the sample recharged at the beginning of each revolution/cycle (except where indicated as charger off). Charge acceptance ($V_{acc}$) and discharge voltage ($V_{dis}$) were established by subjecting the samples to corona charging (erase bar always on) for three complete drum revolutions (laser off); discharged with the laser @ 780 nm & 600 dpi on the forth revolution (50 um spot size, expose 60 nanoseconds/pixel, run at a scan speed of 1,800 lines per second, and use a 100% duty cycle); completely charged for the next three revolutions (laser off); discharged with only the erase lamp @720 nm on the eighth revolution (corona and laser off) to obtain residual voltage ($V_{res}$); and, finally, completely charged for the last three revolutions (laser off). The contrast voltage ($V_{con}$) is the difference between $V_{acc}$ and $V_{dis}$ and the functional dark decay ($V_{dd}$) is the difference in charge acceptance potential measured by probes #1 and #2.
2) VLOGE: This test measures the photoinduced discharge of the photoconductor to various laser intensity levels by monitoring the discharge voltage of the sample as a function of the laser power (exposure duration of 50 ns) with fixed exposure times and constant initial potentials. The complete sample was charged and discharged at incremental laser power levels per each drum revolution. A semi-logarithmic plot was generated (voltage verses log E) to identify the sample's functional photosensitivity, $S_{780nm}$, and operational power settings.
3) DARK DECAY: This test measures the loss of charge acceptance in the dark with time without laser or erase illumination for 90 seconds and can be used as an indicator of i) the injection of residual holes from the charge generation layer to the charge transport layer, ii) the thermal liberation of trapped charges, and iii) the injection of charge from the surface or aluminum ground plane. After the sample has been completely charged, it was stopped and the probes measured the surface voltage over a period of 90 seconds. The decay in the initial voltage was plotted verses time.
4) LONGRUN: The sample was electrostatically cycled for 100 drum revolutions according to the following sequence per each sample-drum revolution. The sample was charged by the corona, the laser was cycled on and off (80–100° sections) to discharge a portion of the sample and, finally, the erase lamp discharged the whole sample in preparation for the next cycle. The laser was cycled so that the first section of the sample was never exposed, the second section was always exposed, the third section was never exposed, and the final section was always exposed. This pattern was repeated for a total of 100 drum revolutions, and the data was recorded periodically, after every 5th cycle for the 100 cycle longrun.
5) After the LONGRUN test, the PRODTEST, VLOGE, DARK DECAY diagnostic tests were run again.

The following Table shows the results from the initial and final prodtest diagnostic tests. The values for the charge acceptance voltage ($V_{acc}$, probe #1 average voltage obtained from the third cycle), discharge voltage ($V_{dis}$, probe #1 average voltage obtained from the fourth cycle), and the residual voltage (Vres, probe 1, average voltage obtained from the eighth cycle) are reported for the initial and final cycles.

TABLE 1

Electrostatic Results after 100 cycles for a first set of samples

| | Prodtest Initial | | | Prodtest Final | | | Changes | |
|---|---|---|---|---|---|---|---|---|
| Samples | Vacc | Vdis | Vres | Vacc | Vdis | Vres | ΔVacc | ΔVdis |
| Comp. Sample A | 729 | 37 | 14 | 701 | 37 | 13 | −28 | 0 |
| Comp. Sample B | 736 | 154 | 143 | 668 | 233 | 176 | −68 | 79 |
| Sample 1 | 727 | 55 | 18 | 681 | 66 | 23 | −46 | 11 |
| Sample 2 | 727 | 83 | 37 | 692 | 83 | 35 | −35 | 0 |
| Sample 3 | 674 | 115 | 67 | 623 | 124 | 68 | −51 | 9 |
| Sample 4 | 735 | 119 | 69 | 693 | 124 | 67 | −42 | 5 |

Note:
1) $V_{acc}$, $V_{dis}$, and $V_{res}$ are charge acceptance voltage, discharge voltage, and residual voltage respectively.
2) ΔVac, ΔVdis are the differences for charge acceptance, and discharge voltages at the start and the end of the cycling.
3) The electrostatic results for each example listed in the table were average values obtained from 2 to 3 sections of each sample after running electrostatic testing for 2 to 3 times of 100 cycles.

Electrostatic evaluation on the 40 mm drum test bed is designed to accelerate electrostatic fatigue during extended cycling by increasing the charge-discharge cycling frequency and decreasing the recovery time as compared to the 160 mm drum test bed.

Electrostatic test stations around the 40 mm drum at 8.13 cm/min.

| Station | Degrees | Total Distance, cm | Total Time, sec |
|---|---|---|---|
| Erase Bar Center | 0° | Initial, 0 cm | Initial, 0 s |
| Corotron Charger | 87.3° | 3.048 | 0.38 |
| Laser Strike | 147.7° | 5.156 | 0.64 |
| Probe #1 | 173.2° | 6.045 | 0.75 |
| Probe #2 | 245.9° | 8.585 | 1.06 |
| Erase Bar Center | 360° | 12.566 | 1.46 |

TABLE 3

Electrostatic Results after 100 cycles for a second set of samples

| | Prodtest Initial | | | Prodtest Final | | | Changes | | Coating | |
|---|---|---|---|---|---|---|---|---|---|---|
| Samples | $V_{acc}$ | $V_{dis}$ | $V_{res}$ | $V_{acc}$ | $V_{dis}$ | $V_{res}$ | $V_{acc}$ | $V_{dis}$ | Appearance | Salt |
| Sample 6 | 718 | 82 | 33 | 663 | 98 | 40 | −55 | 16 | Clear | $LiClO_4$ |
| Sample 7 | 725 | 89 | 36 | 686 | 98 | 40 | −39 | 9 | Clear | $NaClO_4$ |
| Sample 8 | 737 | 155 | 100 | 719 | 196 | 125 | −18 | 41 | Clear | $KClO_4$ |

TABLE 3-continued

Electrostatic Results after 100 cycles for a second set of samples

| | Prodtest Initial | | | Prodtest Final | | | Changes | | Coating | |
|---|---|---|---|---|---|---|---|---|---|---|
| Samples | $V_{acc}$ | $V_{dis}$ | $V_{res}$ | $V_{acc}$ | $V_{dis}$ | $V_{res}$ | $V_{acc}$ | $V_{dis}$ | Appearance | Salt |
| Sample 9 | 737 | 165 | 95 | 719 | 177 | 99 | −18 | 12 | Clear | $CsClO_4$ |
| Sample 10 | 720 | 118 | 64 | 508 | 120 | 64 | −212 | 2 | Hazy | NaF |
| Sample 11 | 563 | 73 | 25 | 354 | 67 | 26 | −209 | −6 | Hazy | KF |
| Sample 12 | 642 | 96 | 45 | 431 | 94 | 45 | −211 | −2 | Clear | CsF |
| Sample 13 | 694 | 114 | 67 | 492 | 104 | 52 | −202 | −10 | Hazy | NaCl |
| Sample 14 | 697 | 112 | 57 | 492 | 108 | 52 | −205 | −4 | Slightly hazy | KCl |
| Sample 15 | 712 | 59 | 19 | 605 | 72 | 24 | −107 | 13 | Hazy | NaBr |
| Sample 16 | 741 | 125 | 62 | 636 | 123 | 58 | −105 | −2 | Clear | KBr |
| Sample 17 | 697 | 70 | 27 | 688 | 86 | 32 | −9 | 16 | Clear | NaI |
| Sample 18 | 705 | 62 | 22 | 690 | 80 | 27 | −15 | 18 | Clear | KI |
| Sample 19 | 677 | 53 | 17 | 620 | 70 | 27 | −57 | 17 | Hazy | LiBr |
| Sample 20 | 700 | 75 | 30 | 681 | 93 | 34 | −19 | 18 | Clear | LiI |

Note:
4) $V_{acc}$, $V_{dis}$, and $V_{res}$ are charge acceptance voltage, discharge voltage, and residual voltage respectively.
5) $\Delta V_{acc}$, $\Delta V_{dis}$ are the differences for charge acceptance, and discharge voltages at the start and the end of the cycling.
6) The electrostatic results for the examples listed in the table were average values obtained from 1 to 3 sections of each sample after running electrostatic testing for 2 to 3 times of 100 cycles.

Example 4

Volume Resistivity Measurement

Volume resistivities of Comparative Sample C and Sample 5 were measured according to ASTM D-257 test method, titled "Standard Test Methods for DC Resistance or Conductance of Insulating materials," incorporated herein by reference.

A Resistance/Resistivity Probe (Model-803B by electro-Tech System Inc., Glenside, Pa.) was used to measure the current under an applied voltage of 200 volts. Volume resistivity of the coatings (V.Rm, in ohm.cm) was calculated according the equation provided by the manufacturer as shown below:

$$V.Rm=7.1*Rm/t$$

where Rm was the resistance of the coating as calculated from the measured current I (nA) under applied voltage U (i.e., Rm=U/I, where U=200 volt) and t was the measured coating thickness (cm).

These measurements demonstrate that the sample with the salt had significantly lower volume electrical resistivity than the comparative sample without the salt.

As understood by those skilled in the art, additional substitution, variation among substituents, and alternative methods of synthesis and use may be practiced within the scope and intent of the present disclosure of the invention. The embodiments above are intended to be illustrative and not limiting. Additional embodiments are within the claims. Although the present invention has been described with reference to particular embodiments, workers skilled in the art will recognize that changes may be made in form and detail without departing from the spirit and scope of the invention.

What is claimed is:

1. An organophotoreceptor comprising:

a) an electrically conductive substrate;

b) a photoconductive element comprising at least a charge generation compound wherein the photoconductive layer is on the electrically conductive substrate; and

TABLE 4

Volume Resistivities of Comparative Sample C and Sample 5.

| Sample | Time (s) | 0.5 | 1 | 30 | 60 | 90 | 120 | 150 | 180 | 210 | 240 | 270 | 300 | 330 | 360 | 390 | 420 |
|---|---|---|---|---|---|---|---|---|---|---|---|---|---|---|---|---|---|
| Comp. Ex. C | Current (nA) | 45 | 28 | 4.20 | 2.40 | 1.90 | 1.60 | 1.40 | 1.3 | 1.2 | 1.1 | 1 | 0.9 | 0.9 | 0.8 | 0.8 | 0.8 |
| | V · Rm, (ohm · cm E + 14) | 1.0 | 1.6 | 10.9 | 19.1 | 24.1 | 28.6 | 32.7 | 35.2 | 38.2 | 41.6 | 45.8 | 50.9 | 50.9 | 57.3 | 57.3 | 57.3 |
| Ex.-5 | Current (nA) | 121 | 108 | 106 | 97.8 | 91.8 | 87.6 | 84.6 | 82.4 | 80.7 | 79.5 | 78.6 | 77.8 | 77 | 76.3 | 75.6 | 74.9 |
| | V · Rm, (ohm · cm E + 14) | 0.5 | 0.5 | 0.5 | 0.6 | 0.6 | 0.6 | 0.7 | 0.7 | 0.7 | 0.7 | 0.7 | 0.7 | 0.7 | 0.7 | 0.8 | 0.8 |

Note:
Data for the measured currents were collected immediately after applying the voltage (i.e., as measured at 0.5 and 1 second) and then every 30 seconds up to 7 minutes till the measured currents were stabilized.

c) an overcoat layer comprising a first binder and at least an inorganic ionic salt wherein the overcoat layer is on the photoconductive layer and wherein the binder is not a silsesquioxane polymer and wherein the inorganic ionic salt is dissolved during incorporation into the overcoat layer, wherein the inorganic ionic salt comprises a multivalent cation selected from the group consisting of $Ca^{+2}$, $Mg^{+2}$, $Sr^{+2}$, $Ba^{+2}$, $Al^{+3}$, $Co^{+2}$, $Ni^{+2}$, $Cu^{+2}$, and $Zn^{+2}$, and wherein the inorganic ionic salt in the overcoat layer is present at a concentration between 0.5% and 50% by weight.

2. An organophotoreceptor according to claim 1 wherein the photoconductive layer further comprises an electron transport compound.

3. An organophotoreceptor according to claim 1 wherein the photoconductive layer further comprises a charge transport compound.

4. An organophotoreceptor according to claim 3 wherein the charge transport compound comprises a stilbenyl group.

5. An organophotoreceptor according to claim 1 wherein the photoconductive layer further comprises a charge transport compound and an electron transport compound.

6. An organophotoreceptor according to claim 1 wherein the first binder is a water-based polymeric binder.

7. An organophotoreceptor according to claim 1 wherein the first binder is an organic polymeric binder.

8. An organophotoreceptor according to claim 1 wherein the first binder is selected from the group consisting of fluorinated polymer, siloxane polymer, fluorosilicone polymer, silane, polyethylene, polypropylene, polyacrylate, poly (methyl methacrylate-co-methacrylic acid), urethane resin, urethane-epoxy resin, urethane-acrylic resin, and a combination thereof.

9. An organophotoreceptor according to claim 1 wherein the inorganic ionic salt in the overcoat layer is present at a concentration between 1% and 30% by weight.

10. An organophotoreceptor according to claim 1 wherein the photoconductive element further comprises a second binder.

11. An organophotoreceptor according to claim 1 further comprising a sublayer located between the electrically conductive substrate and the photoconductive element.

12. An organophotoreceptor according to claim 1 further comprising a barrier layer located between the overcoat layer and the photoconductive element.

13. An organophotoreceptor according to claim 1 wherein the salt comprises an anion selected from the group consisting of $Br^-$ and $I^-$.

14. An organophotoreceptor according to claim 1 wherein the overcoat layer has a thickness from about 0.1 microns to about 20 microns.

15. An electrophotographic imaging apparatus comprising:

(a) a light imaging component; and (b) an organophotoreceptor oriented to receive light from the light imaging component, the organophotoreceptor comprising an electrically conductive substrate and a photoconductive element on said electrically conductive substrate wherein said photoconductive element comprises a charge generation compound and an overcoat layer comprising a first binder and an inorganic ionic salt, wherein the photoconductive layer is on the electrically conductive substrate, wherein the overcoat layer is on the photoconductive layer and wherein the binder is not a silsesquioxane polymer, and wherein the inorganic ionic salt is dissolved during incorporation into the overcoat layer, wherein the inorganic ionic salt comprises a multivalent cation selected from the group consisting of $Ca^{+2}$, $Mg^{+2}$, $Sr^{+2}$, $Ba^{+2}$, $Al^{+2}$, $Co^{+2}$, $Ni^{+2}$, $Cu^{+2}$, and $Zn^{+2}$, and wherein the inorganic ionic salt in the overcoat layer is present at a concentration between 0.5% and 50% by weight.

16. An electrophotographic imaging apparatus according to claim 15 wherein the photoconductive element further comprises an electron transport compound.

17. An electrophotographic imaging apparatus according to claim 15 wherein the photoconductive element further comprises a charge transport compound.

18. An electrophotographic imaging apparatus according to claim 15 wherein the first binder is a water-based polymeric binder.

19. An electrophotographic imaging apparatus according to claim 15 wherein the first binder is an organic polymeric binder.

20. An electrophotographic imaging apparatus according to claim 15 wherein the inorganic ionic salt in the overcoat layer is present at a concentration between 1% and 30% by weight.

21. An electrophotographic imaging apparatus according to claim 15 wherein the cation is selected from the group consisting of lithium cation and sodium cation.

22. An electrophotographic imaging apparatus according to claim 15 wherein the photoconductive element layer further comprises a second binder.

23. An electrophotographic imaging apparatus according to claim 15 further comprising a liquid toner dispenser.

24. An electrophotographic imaging process comprising:

(a) applying an electrical charge to a surface of an organophotoreceptor comprising an electrically conductive substrate; a photoconductive layer comprising a charge generation compound; and an overcoat layer comprising a first binder and at least an inorganic ionic salt, wherein the photoconductive layer is on the electrically conductive substrate, wherein the overcoat layer is on the photoconductive layer and wherein the binder is not a silsesquioxane polymer, and wherein the inorganic ionic salt is dissolved during incorporation into the overcoat layer, wherein the inorganic ionic salt comprises a multivalent cation selected from the group consisting of $Ca^{+2}$, $Mg^{+2}$, $Sr^{+2}$, $Ba^{+2}$, $Al^{+3}$, $Co^{+2}$, $Ni^{+2}$, $Cu^{+2}$, and $Zn^{+2}$, and wherein the inorganic ionic salt in the overcoat layer is present at a concentration between 0.5% and 50% by weight.

(b) imagewise exposing the surface of the organophotoreceptor to radiation to dissipate charge in selected areas and thereby form a pattern of charged and uncharged areas on the surface;

(c) contacting the surface with a toner to create a toned image; and (d) transferring the toned image to a substrate.

25. An electrophotographic imaging process according to claim 24 wherein the photoconductive layer further comprises at least an electron transport compound.

26. An electrophotographic imaging process according to claim 24 wherein the photoconductive layer further comprises at least a charge transport compound.

27. An electrophotographic imaging process according to claim 24 wherein the first binder is a water-based polymeric binder.

28. An electrophotographic imaging process according to claim 24 wherein the first binder is an organic polymeric binder.

29. An electrophotographic imaging process according to claim 24 wherein the inorganic ionic salt in the overcoat layer is present at a concentration between 1% and 30% by weight.

30. An electrophotographic imaging process according to claim 24 wherein the photoconductive element further comprises a second binder.

31. An electrophotographic imaging process according to claim 24 wherein the salt comprises an anion selected from the group consisting of $Br^-$ and $I^-$.

32. An organophotoreceptor comprising:

a) an electrically conductive substrate;

b) a photoconductive element comprising at least a charge generation compound wherein the photoconductive layer is on the electrically conductive substrate; and c) an overcoat layer comprising a first binder and at least an inorganic ionic salt wherein the overcoat layer is on the photoconductive layer and wherein the binder is not a silsesquioxane polymer, wherein the inorganic ionic salt comprises a multivalent cation selected from the group consisting of $Ca^{+2}$, $Mg^{+2}$, $Sr^{+2}$, $Ba^{+2}$, $Al^{+3}$, $Co^{+2}$, $Ni^{+2}$, $Cu^{+2}$, and $Zn^2$ and the anion is a polyatomic inorganic anion, and wherein the inorganic ionic salt in the overcoat layer is present at a concentration between 0.5% and 50% by weight.

33. The organophotoreceptor of claim 32 wherein the polyatomic inorganic anion is selected from the group consisting of $NO_3^-$, $SO_4^{-2}$ and $ClO_4^-$.

* * * * *